US005658026A

United States Patent [19]

Nigro, Jr. et al.

[11] Patent Number: 5,658,026

[45] Date of Patent: Aug. 19, 1997

[54] DOOR HANDLE LOCKING MECHANISM WITH DUAL FUNCTION SPRINGS

[75] Inventors: Daniel N. Nigro, Jr.; Theodore J. Fritsch, both of Indianapolis, Ind.

[73] Assignee: Von Duprin, Inc., Indianapolis, Ind.

[21] Appl. No.: 523,714

[22] Filed: Sep. 5, 1995

[51] Int. Cl.[6] ..... E05B 3/00

[52] U.S. Cl. ..... 292/336.3; 70/210

[58] Field of Search ..... 292/336.3; 70/210, 70/211

[56] References Cited

U.S. PATENT DOCUMENTS

| | | | |
|---|---|---|---|
| 2,138,856 | 12/1938 | Harp | 70/216 |
| 4,915,432 | 4/1990 | Gressett, Jr. | 292/336.3 |
| 4,979,767 | 12/1990 | Lin | 292/336.3 |
| 4,982,986 | 1/1991 | Gressett, Jr. et al. | 292/336.3 |
| 4,988,136 | 1/1991 | Gressett, Jr. et al. | 292/336.3 |
| 5,205,596 | 4/1993 | Ralph | 292/336.3 |
| 5,433,497 | 7/1995 | Koening | 292/359 |
| 5,445,423 | 8/1995 | Mader | 292/336.3 |
| 5,496,082 | 3/1996 | Zuckerman | 292/336.3 |

FOREIGN PATENT DOCUMENTS

| | | | |
|---|---|---|---|
| 511483 | 4/1955 | Canada | 70/211 |
| 0 430 420 A2 | 6/1991 | European Pat. Off. . | |
| 0 662 554 A2 | 7/1995 | European Pat. Off. . | |
| 2 123 070 | 1/1984 | United Kingdom . | |

*Primary Examiner*—Steven N. Meyers
*Assistant Examiner*—Donald J. Lecher
*Attorney, Agent, or Firm*—Robert F. Palermo

[57] ABSTRACT

A modular door handle assembly has a door handle on a rotatable handle shaft mounted on a housing having a face with a bore for receiving the handle shaft. Dual-function studs retain a cover on the housing and have provision for mounting the door handle assembly to a door. Other provisions, within the housing, provide for operating a door latch in response to rotation of the door handle together with a mechanism for returning the handle to a parked position upon release of the handle from rotating force and a locking feature for releasably locking the door handle assembly to prevent operation of the door latch. The handle return and locking features are both driven by a pair of dual acting springs. The modular design simplifies repair and replacement of the assembly.

6 Claims, 6 Drawing Sheets

DOOR HANDLE LOCKING MECHANISM WITH DUAL FUNCTION SPRINGS

CROSS REFERENCE TO RELATED APPLICATIONS

This application is related to United States patent application Ser. No 08/523,712, filed on Sep. 5, 1995 under Docket Number 2462-SL-VD by the inventors herein and assigned to the assignee of the present invention.

BACKGROUND OF THE INVENTION

This invention relates generally to door handle assemblies for use with panic exit devices and more particularly to modular door handle assemblies which have redundant dual-action handle return springs which also have a lock detent function.

Currently available door handle assemblies with internal locking require relatively complex locking and unlocking mechanisms with separate springs for handle return and locking functions. They consist of several parts and are spring loaded so that repairs required because of damage due to vandalism or routine wear and tear are often difficult to accomplish without losing or damaging some parts. This increases down time, repair time, and thus the cost of maintenance and repair for buildings employing such locks.

The foregoing illustrates limitations known to exist in present door handle assemblies, and it would be advantageous to provide an alternative directed to overcoming one or more of those limitations. Accordingly, a suitable alternative is provided including features more fully disclosed hereinafter.

SUMMARY OF THE INVENTION

In one aspect of the present invention, a door handle assembly is provided including a door handle on a rotatable handle shaft; a housing having a face with a bore for receiving the handle shaft and having means for mounting the door handle assembly to a door; means, mounted in the housing, for operating a door latch in response to rotation of the door handle; means for returning the handle to a parked position upon release of the handle from rotating force; and means for releasably locking the door handle assembly to prevent operation of the door latch.

The foregoing and other aspects of the invention will become apparent from the following detailed description, when considered in conjunction with the accompanying drawings.

DETAILED DESCRIPTION

Figure 1:
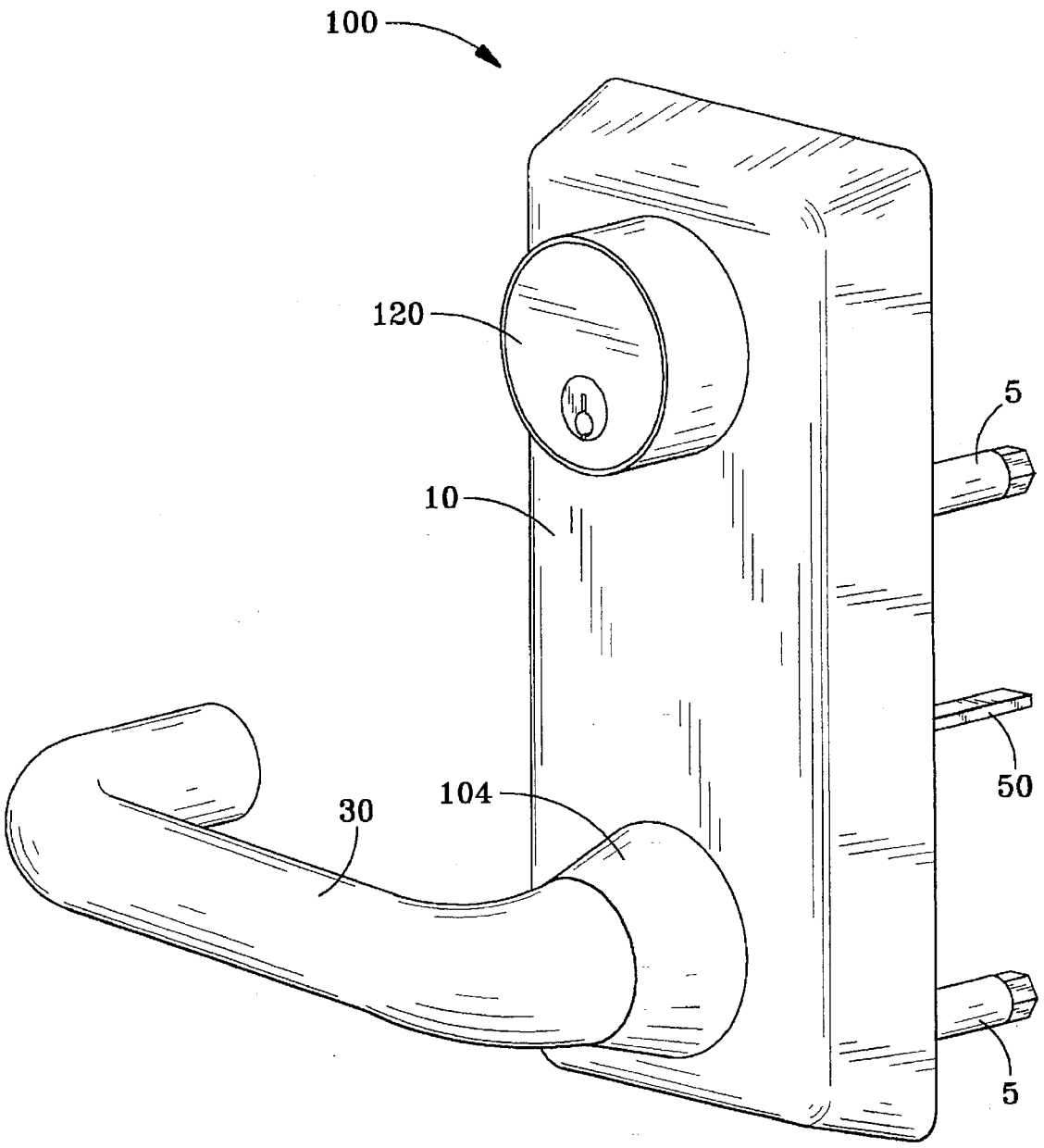
FIG. 1 is a schematic front perspective view illustrating a modular door handle assembly.

FIG. 1 shows the environment of the invention. A modular door handle assembly 100 has a housing 10, a lock 120, and a handle 30. In this view, mounting studs 5 and tailpiece 50 are seen extending rearwardly from the back of the housing. This type of handle assembly is usually used with panic exit devices opposite the push bar. Note that a lever is shown here, since levers are most commonly used in commercial buildings where panic exit devices are provided; but any type of handle including push-pull handles, thumb lever handles, or knobs may be used.

Figure 2:
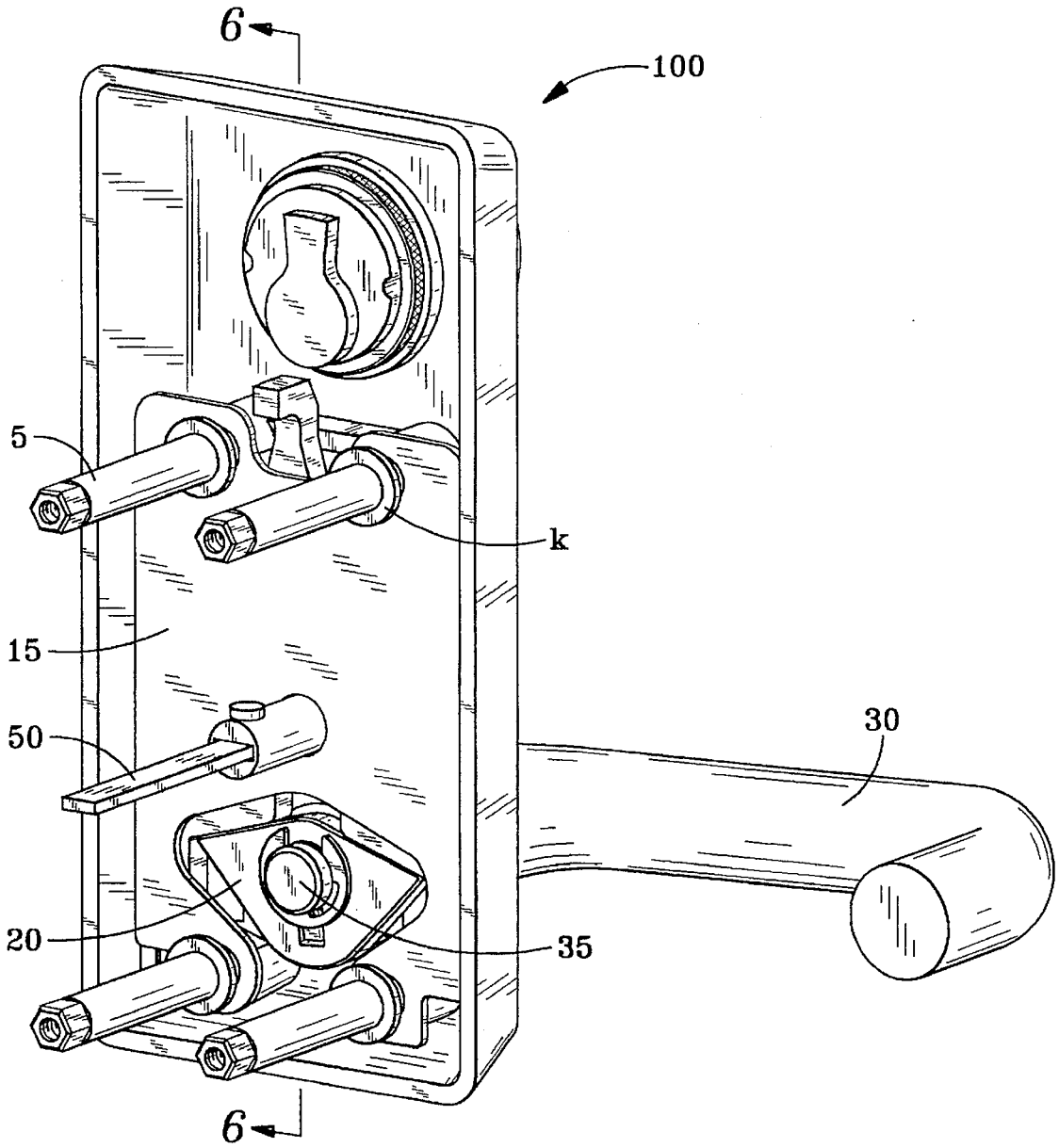
FIG. 2 is a schematic rear perspective view of the door handle assembly shown in FIG. 1.

The invention is best described by reference to all six figures; because not all features are visible in every figure and, for the sake of clarity, not every feature is numbered in every figure. Modularity of the assembly is best illustrated in FIGS. 1 & 2, while structure and operation are best illustrated by referring to FIGS. 3–6.

FIGS. 2–6 show that assembly 100 has a housing 10, in which are mounted the handle shaft 35, cam 20, slider 60, lock bar 80, locking lugs 85, springs 90, dogs 95, and input cam 70; all of which, except for cam 20 are mounted behind cover plate 15. The cover plate 15 is secured to housing 10 by studs 5, which also serve as fasteners for mounting the modular door handle assembly to a door. These dual-function studs each have a skirt "k" which retains the cover plate 15 against the housing 10 whether the assembly 100 is attached to a door or not. For fire door installations, the studs are designed to remain in place, even after door lock trim components have melted away, and to maintain attachment of the door lock mechanism. A ledge 11 of the housing 10 surrounds most of the lower portion of the housing and act as a stand-off support for cover 15, a guide for slide 60, and a retainer and guide for dogs 95. Thus, the cover does not interfere with movement of the slide, cam, dogs, lock bar, or input cam; but it does maintain the parts in alignment for smooth operation.

Handle shaft 35 extends from lever 30 through housing 10 and protrudes far enough for mounting the cam 20 and its retaining ring 24. A transverse through-drilled bore "b" is provided in lever shaft 35 for driving the cam 20 when it is installed on the shaft. A shear pin 22 of a length L greater than the diameter D of lever shaft 35 (preferred L is equal to approximately 1.5×D) is installed in bore "b" of the lever shaft. Cam 20 has a bore with a diameter which is a slip fit on lever shaft 35 and also preferably has symmetric opposed lobes 25 to coact with the slider 60 for either left or right handing of levers. It has a recess or slot "a" extending radially from the bore of cam 20. This slot does not extend completely through cam 20 and, when the cam 20 is installed the slot "a" aligns with the transverse bore "b" through lever shaft 35 and receives the protruding portion of shear pin 22. Thus, when shear pin 22 is installed in bore "b" of lever shaft 35 and cam 20 is slipped onto the shaft, the shear pin 22, which has a slip fit in the bore "b", nests in the slot or recess "a" and is retained in the shaft by the cam. This transmits torque between the lever shaft 35 and cam 20 so that, when the lever 30 is moved, the cam responds; and, conversely, when the cam 20 is moved by the return mechanism described below the shaft 35 also turns and returns the lever 30 to its parked position.

The shear pin 22 also provides protection for the door handle assembly 100 against vandalism and over-torquing in general. If excessive torque is applied, the shear pin 22 fails and the handle 30 turns freely, thereby avoiding damage to other parts of the assembly. Because the cam 20 and shear pin 22 have slip fits with the lever shaft, they are easily removed for replacement. The cam 20 is secured on shaft 35 by retaining ring 24. Thus, the retaining ring 24, retains cam 20, which has a slip fit on shaft 35, on the shaft; and the cam 20 retains shear pin 22, which has a slip fit in transverse bore "b" and protrudes into the slot "a" of the cam 20, to ensure co-rotation of shaft 35 and cam 20 under normal operating conditions.

Figure 3:
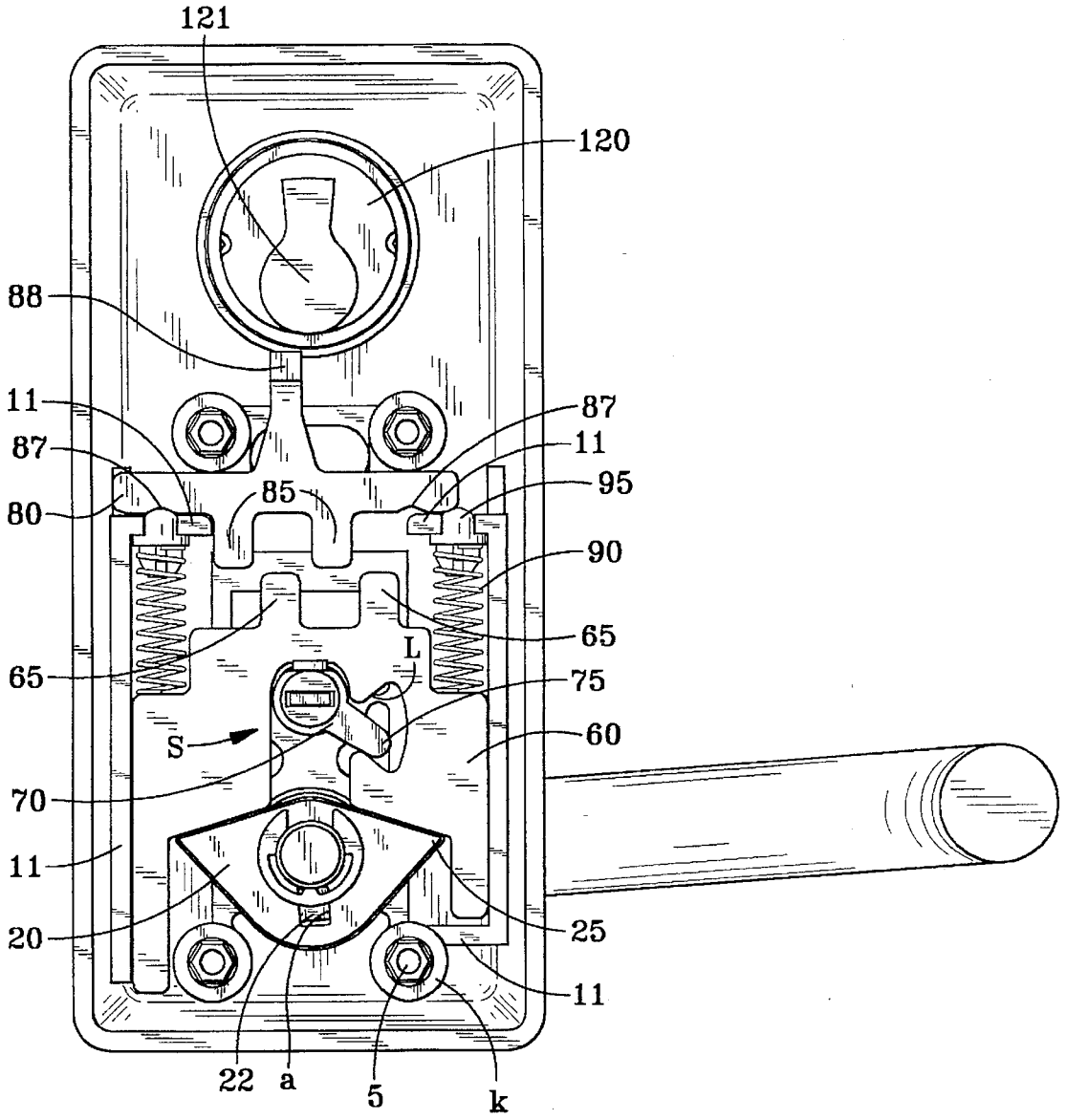
FIG. 3 is a schematic view of the assembly in FIG. 2, with the cover plate removed to show the operating mechanism of the invention in the parked position.
Figure 4:
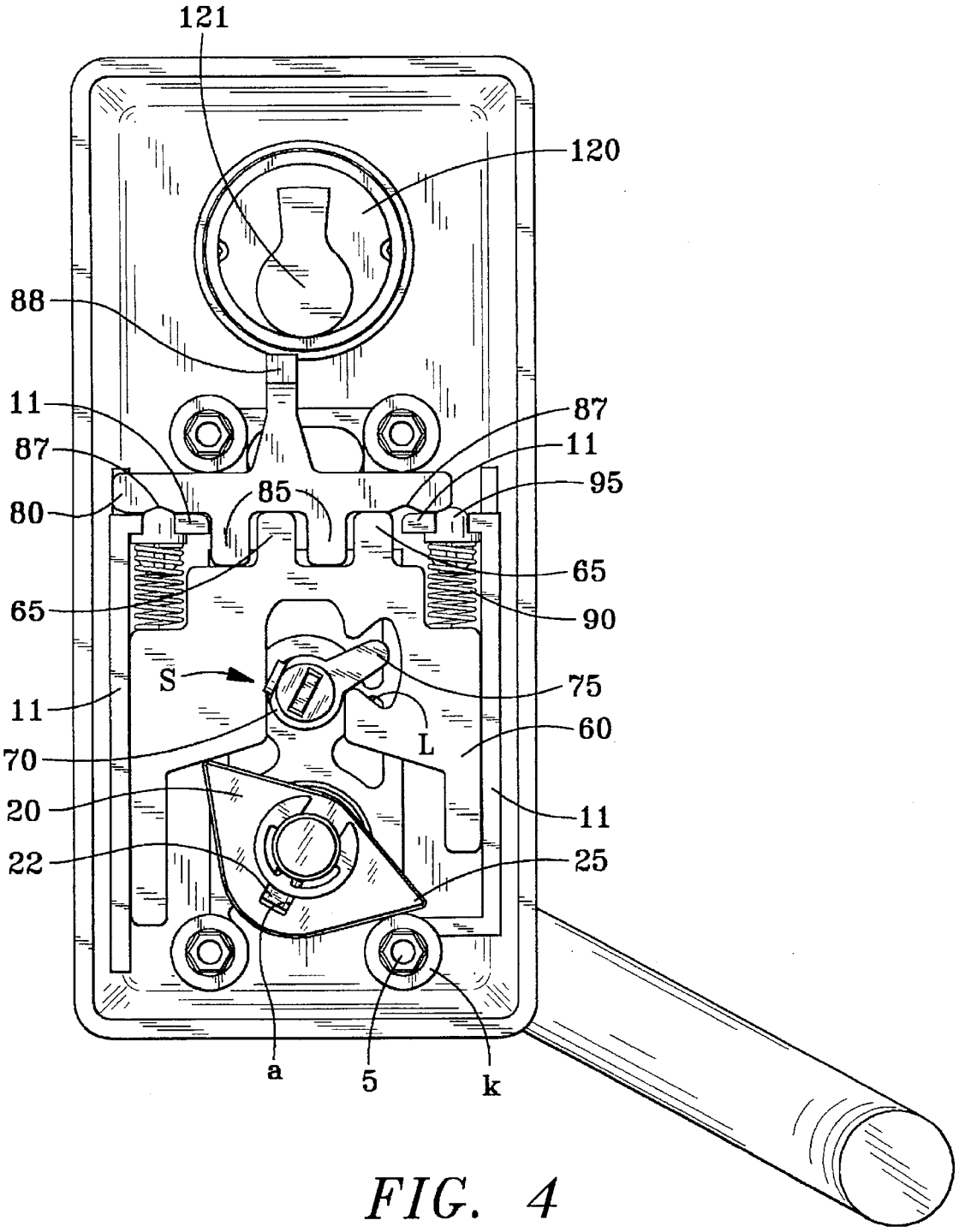
FIG. 4 is a view as in FIG. 3 showing the handle assembly in the latch-retracted position.
Figure 5:
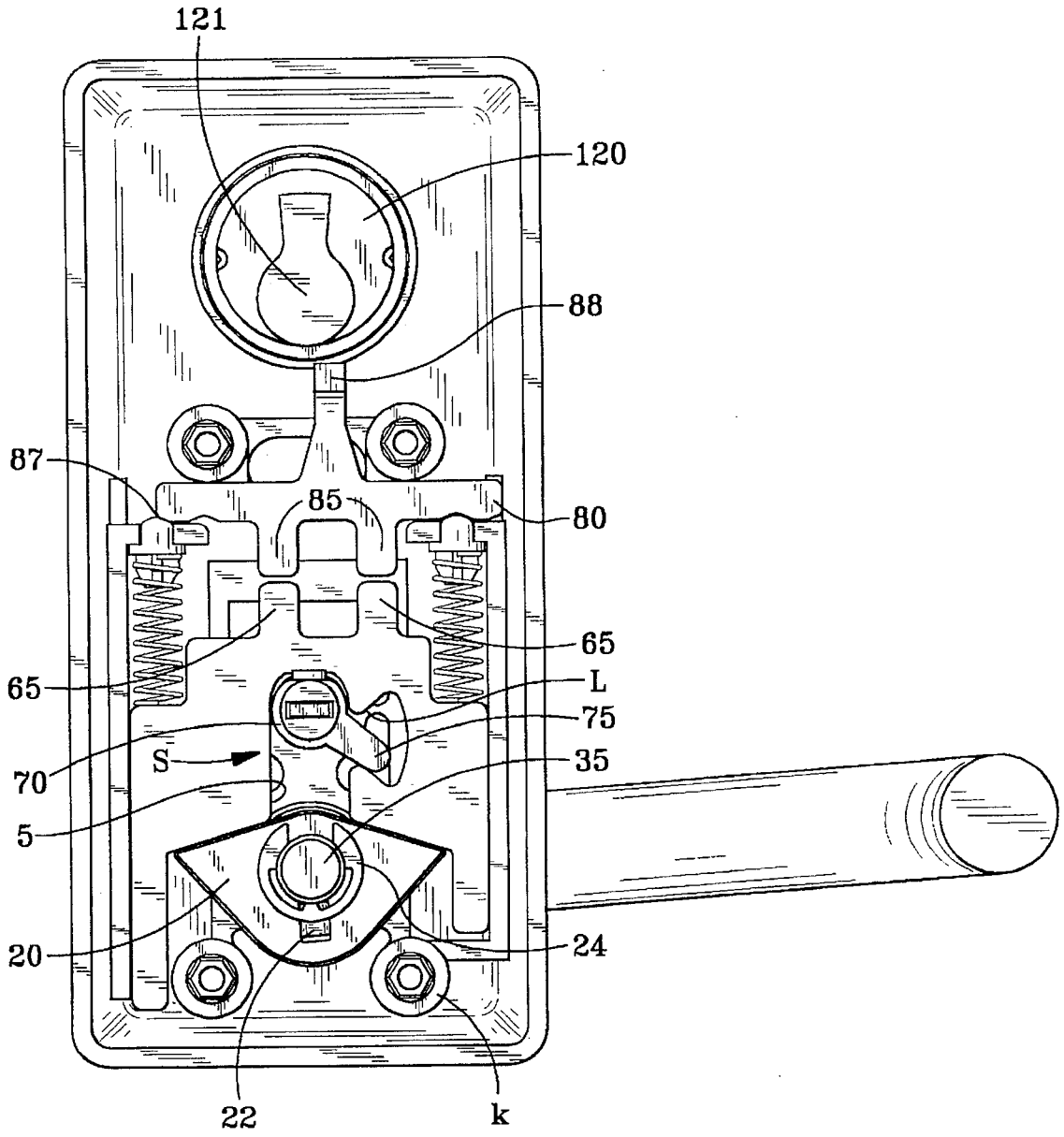
FIG. 5 is another view as in FIG. 3 showing the operating mechanism in the parked and locked position.

FIGS. 3–5, in which the cover plate 15 has been removed, illustrate further details of the invention, in which, when cam 20 is symmetrical lobes 25 are identical and have the same driving effect on the slider 60 regardless of the direction in which the handle 30 and handle shaft 35 rotate. When the handle 30 is rotated, shaft 35 and cam 20 also rotate. Cam lobes 25 push against slider 60 to move the slider and to thereby move the lever arm 75 of cam 70 which is positioned in the lateral branch "L" of the branched slot "S" of the slider. This causes rotary motion of the cam 70 which is transferred by input cam shaft 40 to tailpiece 50 and thence to the door latch spindle (not shown). Preferably, pin 45 retains tailpiece 50 in shaft 40 of cam 70 by extending through a transverse bore in the shaft 40, the bore being aligned with a hole (not numbered) in the tailpiece 50.

When the door handle 30 is operated, handle shaft 35 turns and causes cam 20 to turn. Cam lobes 25 push against the slider 60 and drive it upward against the springs 90. As the slide moves upward, the lateral branch L of the branched slot S drives cam lever 75 causing cam 70 to rotate. This drives cam shaft 40 and tailpiece 50 to operate a door latch spindle (not shown) and unlatch the door.

FIG. 3 shows the operating sequence before it has begun, and FIG. 4 shows the sequence at its end. It can be seen that springs 90 are compressed in FIG. 4 by the upward displacement of the slide 60 caused by operation of the door handle 30. FIG. 4 also shows the lock bar 80 and the locking lugs 85 which are interdigitated with similar projections 65 of slide 60 when the lock bar is in the unlocked position. Upon release of the handle 30 from the rotating force imposed upon it to operate the latch, springs 90 return to their extended position seen in FIG. 3, and in doing so, drive slide 60 downward, thereby returning input cam 70, cam lever 75, cam 20, handle shaft 35, and handle 30 to their parked positions. The compression springs 90 are very strong and durable, and because of the redundancy provided by the invention structure, are doubly so in this application.

The locked position of lock bar 80 is shown in FIG. 5. Notice that locking lugs 85 are aligned with the projections 65 of the slide 60 and prevent upward movement of the slide. A lock bar arm 88 extends from the lock bar 80 and is usually operated by a thumb turn (not shown) from the inside of the door and by a key lock 120 and cam 121 from the outside. In its leftward position, the lock bar 80 and locking lugs 85 are clear of the path of the projections 65 of the slide 60, and the slide is free to move. In the rightward position shown in FIG. 5, lugs 85 are aligned with the projections 65, and the mechanism is locked.

There are two detents 87 in the lower edge of lock bar 80 which are spaced so that one of the detents is always aligned with one of two co-acting spring-loaded dogs 95 to retain the lock bar 80 in either the locked or unlocked position. The dogs 95 project slightly above the portion of housing ledge 11 in which they are supported, such that their tapered ends are in continuous contact with the surface of lock bar 80. When the lock bar is in the unlocked position, the left dog and left detent are engaged. When the lock bar is in the locked position, the right dog and the right detent are engaged. The ends of the lock bar 80 have a taper corresponding to half of the detent so that, when either dog 95 is engaged, the other rests against the tapered end of the lock bar and reinforces the retaining action. The dogs 95 are spring-loaded by the dual-acting springs that also return the slide and handle to the parked position when the handle is released. The retaining action is, therefore, very positive and distinct.

Figure 6:
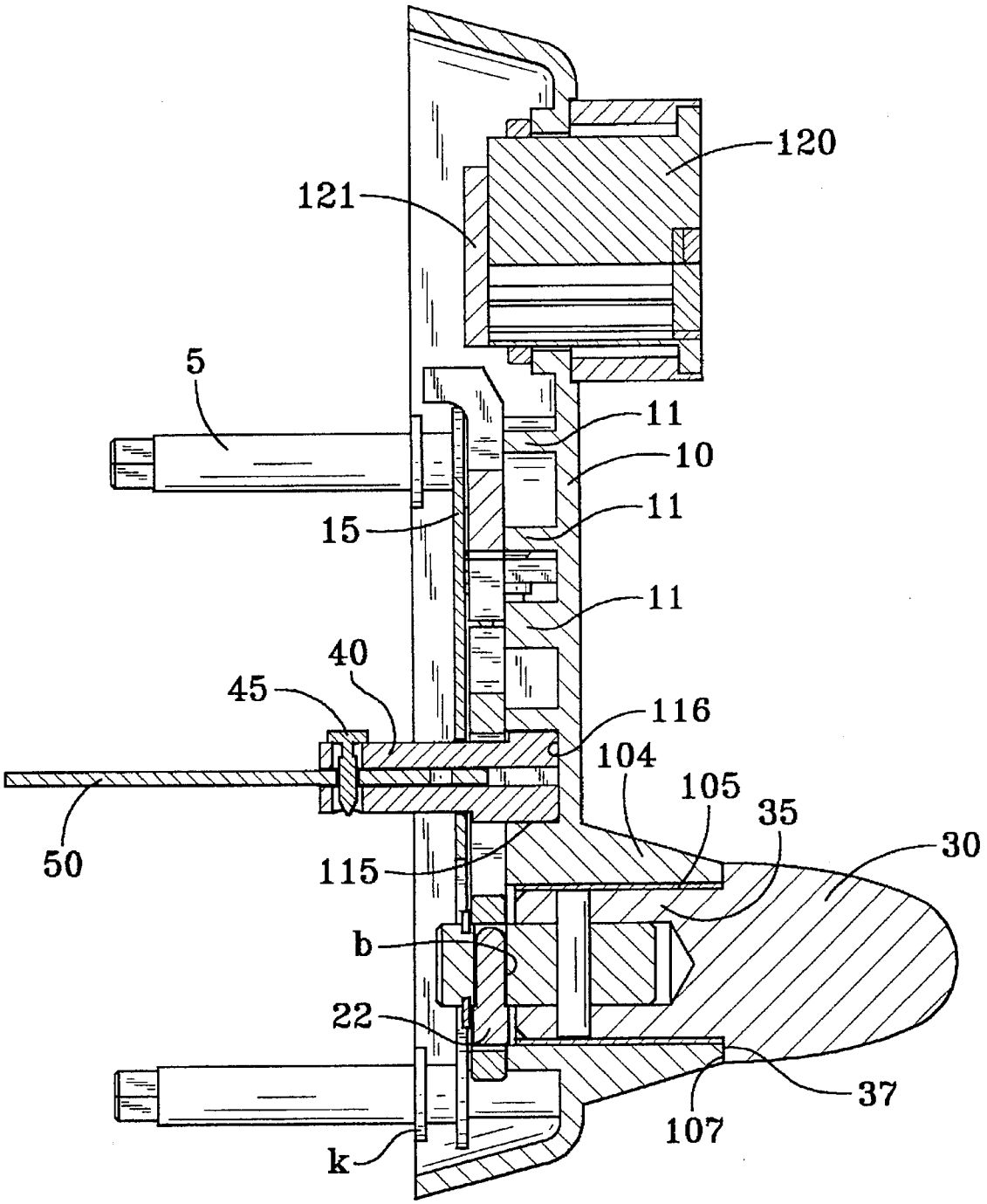
FIG. 6 is a sectional view illustrating the bearings and other features of the housing as well as construction details of the modular handle assembly.

The integrally formed thrust and rotation bearings for the door handle 30, door handle shaft 35, and input cam shaft 40 are illustrated by reference to FIGS. 1 and 6. When forming the housing 10, by casting, pressing and sintering, machining, molding, or welding, cores or inserts are placed so that bearing surfaces are provided at appropriate locations. Boss 104 on housing 10 provides a sufficient mass to accommodate the integral bearing function. As shown, there is an insert 105 which has the actual rotation bearing surface for the handle shaft 35. End face 107 of the boss 104 provides the thrust bearing against which shoulder 37 of handle 30 bears. Using the insert or not, it is usually required to do some final grinding, honing, or polishing to get the best bearing surfaces. For the input cam shaft 40, bore wall 115 and bore end 116 act as the rotation and thrust bearing surfaces, respectively. Use of integrally formed bearings speeds and simplifies assembly by eliminating the need for installing and aligning of loose bearings.

The mounting studs 5 are used for mounting the modular door handle assembly to the door and also for holding the assembly together in the housing. Except for the lock 120 and the cam 20, virtually all the parts of the assembly 100, according to the invention, are held in the housing 10 by the cover plate 15, which is fastened in place by the four (preferably) studs 5 after the other components are installed. This simplifies and speeds manufacturing the modular handle assemblies by minimizing the number of parts and also the number of operations which require use of tools.

This invention provides modular door handle assemblies for installation primarily in doors with panic exit devices. Installation is simplified, and durability of the assembly in service is assured by the minimal number of parts required and by the redundancies of the design. The locking mechanism is simple, but it is ruggedly made, as are all working parts of the lock.

What is claimed is:

1. A modular door handle assembly, comprising:

a door handle on a rotatable handle shaft;

a housing having a face with a bore for receiving said handle shaft;

means for mounting said door handle assembly to a door;

means, mounted in said housing, for operating a door latch in response to rotation of said door handle comprising;

a cam on said handle shaft, said cam driven thereby against a surface of a slide, thereby moving the slide when the handle shaft is rotated;

an input cam rotatably mounted in said housing, said input cam having a shaft, with means for transmitting rotary motion to a latch spindle, and a lever arm for rotatably driving said input cam and shaft;

said slide surrounding the input cam and having a branched slot for permitting the slide to move relative to the shaft of said input cam while driving said lever arm to rotate the shaft of said input cam and thereby to operate said door latch;

means for returning said handle to a parked position upon release of said handle from rotating force comprising two dual-action compression springs interposed between said slide and said housing, both of which springs are compressed by rotation of said handle shaft in either a clockwise or counter-clockwise direction until the handle is released; and means for releasably locking said door handle assembly to prevent operation of said door latch comprising;

a lock bar having at least one locking lug, said lock bar being movable to a position in which the locking lug blocks movement of said slide, thereby preventing rotation of said handle shaft and operation of said door latch; two detent notches in a surface of said lock bar; and two spring-loaded dogs, one of which is always aligned with one of said detent notches, said dogs being spring loaded by the same dual-action compression springs which return the slide and handle to parked positions, said dogs further having tapered surfaces for engaging said detent notches and for retaining said lock bar in a position in which the locking lug either blocks or allows movement of said slide, to prevent or permit rotation of said handle shaft and operation of said door latch.

2. The modular door handle assembly of claim 1, further comprising:

integrally formed thrust and rotation bearings in said housing for said handle and said handle shaft.

3. The modular door handle assembly of claim 1, wherein the means for mounting said door handle assembly to a door comprises a plurality of dual-action studs which also serve as fasteners for assembling said modular door handle assembly.

4. In a modular door handle assembly, for use with a panic exit device, said assembly having a handle with a handle shaft for imparting rotational motion to a door latch spindle, the improvement in combination with said door handle assembly, comprising:

a housing having a face with a bore for receiving said handle shaft, and having integrally molded thrust and rotation bearings for said handle shaft;

means for mounting said door handle assembly to a door;

a cam drivably mounted on said handle shaft in driving engagement with a slide which moves in response to rotation of said handle shaft;

an input cam rotatably mounted in said housing, having a shaft protruding through a branched slot in said slide and having a lever arm extending into a lateral branch of said slot, such that said slide is free to move relative to said input cam shaft but that such movement displaces said lever arm and rotates said input cam shaft and thereby operates said door latch;

two dual-action compression springs interposed between said slide and said housing, such that both said springs are compressed by movement of the slide in response to rotation of said handle and said handle shaft and, when said handle is released, both said springs expand to return said slide and said handle to parked positions; and means for releasably locking said door handle assembly to prevent operation of said door latch, said means including a lock bar having two detent notches and at least one locking lug, and being movable to a position for blocking movement of said slide, said detent notches being located such that one or the other is always aligned with one or the other of said dual action compression springs, each compression spring also having a dog which protrudes through a housing member such that one or the other of said dogs makes contact with one .or the other of said lock bar detent notches to retain the lock bar in a desired locked or unlocked condition.

5. The combination of claim 4, wherein the means for mounting said door handle assembly to a door comprises a plurality of dual-action studs which also serve as fasteners for assembling the modular door handle assembly.

6. A modular door handle assembly, comprising:

a door handle on a rotatable handle shaft;

a housing having a decoratively finished face with a bore for receiving said handle shaft and an opening for receiving a lock cylinder;

thrust and rotation bearings, for said handle and said rotatable handle shaft, integrally formed in said housing;

means on said housing for mounting said door handle assembly to a door;

means, including a cam driven slide arrangement, for operating a door latch in response to rotation of said door handle;

two dual acting compression springs interposed between a member of said housing and said slide for returning said handle to a parked position upon release of said handle from rotating force;

means for locking said door handle assembly to prevent operation of said door latch, said means including a lock bar having two detent notches and at least one locking lug, and being movable by a cam of said lock cylinder to a position for blocking movement of said slide, said detent notches being located such that one or the other is always aligned with one or the other of said dual action compression springs, each compression spring also having a dog which protrudes through said housing member such that one or the other of said dogs makes contact with one or the other of said lock bar detent notches to retain the lock bar in a desired locked or unlocked condition; and a cover plate mounted inside said housing to protect operating components of said modular door handle assembly.

* * * * *